United States Patent [19]

Hartung

[11] 4,109,892

[45] Aug. 29, 1978

[54] ADJUSTABLE EASEL

[76] Inventor: John P. Hartung, 1557 Merry Ave., Bronx, N.Y. 10461

[21] Appl. No.: 811,726

[22] Filed: Jun. 30, 1977

[51] Int. Cl.[2] ..... A47B 97/04

[52] U.S. Cl. ..... 248/449; 248/455; 248/458; 248/464

[58] Field of Search ..... 248/441 R, 448, 449, 248/454, 455, 456, 458, 460, 463, 464, 465

[56] References Cited

U.S. PATENT DOCUMENTS

| | | | |
|---|---|---|---|
| 374,116 | 11/1887 | Cross | 248/449 |
| 410,226 | 9/1899 | White | 248/449 |
| 743,048 | 11/1903 | Suffern | 248/455 |
| 1,821,060 | 9/1931 | Isaacson | 248/455 |
| 2,526,527 | 10/1950 | Zander | 248/463 |
| 3,809,354 | 5/1974 | Phifer | 248/452 |
| 4,042,203 | 8/1977 | Warkentin | 248/463 |

*Primary Examiner*—William H. Schultz

*Attorney, Agent, or Firm*—Kirschstein, Kirschstein, Ottinger & Cobrin

[57] ABSTRACT

An adjustable easel of generally triangular configuration mounted on a rotatable support disc or the like. The angle of inclination and/or the height of the front support for an oil painting or the like may be adjusted by either changing the length of the rear support, which pivots about its base, and/or by changing the distance between the respective base pivots of the front and rear supports. In addition, since the easel is mounted on a rotatable support, the entire easel may be turned in or to any position for best viewing and light, without motion of the painter or loss of concentration on the subject being painted. This feature in addition to the movable vertical adjustment allows the easel to be disposed at many angles or orientations as desired for best positioning relative to the object being painted and the light source.

14 Claims, 7 Drawing Figures

ADJUSTABLE EASEL

BACKGROUND OF THE INVENTION

1. Field of the Invention

An adjustable easel.

2. Description of the Prior Art

Adjustable artist's easels have been disclosed in U.S. Pat. No. Des. 193,665, and in U.S. Pat. Nos. 3,809,354 and 3,926,398. In general, the prior art provides either inclination of the canvas rest and holder from the vertical by means of relatively simple structure, or an easel mounted on casters and having no rotation feature. Various types of structure for inclining the easel have been proposed, however the prior art is uniformly devoid of the combination of an easel which may be inclined and also concomitantly rotatably adjusted on its standard.

SUMMARY OF THE INVENTION

Purposes of the Invention

It is an object of the present invention to provide an improved adjustable easel.

Another object is to provide an adjustable easel which may be concomitantly rotated as well as inclined to any suitable angle.

A further object is to provide an adjustable easel which accommodates for suitable orientation of the canvas relative to the subject as well as a variety of light sources of differing intensities and directions.

An additional object is to provide an adjustable easel which may be inclined to a suitable angle by either or both of two dimensional changes in the triangular configuration of the easel.

Still another object is to provide an adjustable easel which may be turned in or to any position for best light, without necessitating motion of the artist or painter and without losing concentration on the subject being painted.

Still a further object is to provide an adjustable easel which may be turned or rotated in a 360° circle.

Still an additional object is to provide an adjustable easel which has a movable vertical adjustment so that the easel may be laid at many angles for painting or drafting, e.g. 0° to 40° from the vertical.

Still another object is to provide an adjustable easel with a slide adjustment at the base of the easel to give a variety of wider angles to the triangular easel configuration.

These and other objects and advantages of the present invention will become evident from the description which follows.

BRIEF DESCRIPTION OF THE INVENTION

In the present invention, an adjustable easel is provided in which several adjustable or rotatable means for modifying the disposition and inclination of the easel are provided. In a preferred embodiment, the easel includes a base adapted to be set on a horizontal surface, a support which is typically disc-shaped, means such as a central vertical pin mounting the support on the base for rotation about a vertical axis, a first linear member of the frame of the easel, which linear member in practice will be straddled by parallel lateral frame members, and which linear member is oriented in a generally upright position, means such as a horizontal cylindrical rod pivotally mounting the lower end of the first member on the support for pivotal movement of the first member about a horizontal axis adjacent its lower end, a second linear member of the frame of the easel, which second member in practice will be straddled by parallel lateral frame members, and which second member is pivotally mounted at its upper end to the upper end of the first member for pivotal movement about a horizontal axis, e.g. the mounting is another horizontal cylindrical rod, with the second member depending generally vertically from the upper end of the first member, means such as still another horizontal cylindrical rod pivotally mounting the lower end of the second member on the support for pivotal movement of the second member about a lower horizontal axis, and means such as a bracket or shelf mounted on the first member to support the lower edge of a flat object such as a canvas to be painted on, which is mounted on a peripheral rectangular frame. In addition, and most importantly, the inventive combination includes either or both of first adjustable means to selectively change the length of the second member, and second adjustable means to selectively change the distance between the means pivotally mounting the lower end of the first member on the support and the means pivotally mounting the lower end of the second member on the support.

Thus, the present invention permits a multiplicity of adjustments of the easel into a variety of disposition, both with regard to inclination and also with regard to rotation, or partial rotation, about a vertical axis.

The first adjustable means, namely the means to selectively change the length of the second member, preferably entails the provision of a first and a second section of the second member. In a preferred embodiment as will appear infra, the second member actually consists of two parallel and spaced-apart lateral frame members. In any case, the lower portion of the first section is slidably juxtaposed with the upper portion of the second section. Attachment means extend between the juxtaposed portions of the first and second sections of the second member. The attachment means are adjustable so that the lower portion of the first section may be slidable along the upper portion of the second section to a desired position and thereafter maintained in the desired position by manipulation of the attachment means.

The second adjustable means, namely the means to selectively change the distance between the means pivotally mounting the lower end of the first member on the support, and the means pivotally mounting the lower end of the second member on the support, preferably entails the provision of pivotal mounting means for each of these lower ends consisting of a horizontal cylindrical rod mounted on a support consisting of a movable platform. A first rod is provided for pivotally mounting the lower end of the first member on the support, and a second rod is provided for pivotally mounting the lower end of the second member on the support. A first pair of spaced-apart horizontal straight linear beams are disposed on and attached to the support, i.e. the movable platform. The first pair of beams extend rearwards from pivotal attachment to the first rod and are generally perpendicular to the first rod. Each one of a second pair of spaced-apart horizontal straight linear beams slidably engages one of the first pair of beams. The second pair of beams are laterally connected so that the second pair of beams are horizontally displaceable in unison. The second rod is attached to the second pair of beams.

In a preferred embodiment, the second pair of beams are laterally connected by a transverse beam or beams, and an adjustment beam extends generally perpendicularly from attachment to the transverse beam and is provided with slide adjustment means. The slide adjustment means typically entails the provision of a second transverse beam below the adjustment beam. The second transverse beam is attached to the first pair of beams and/or to the support (movable platform), and the second transverse beam is provided with an upper opening. The adjustment means in this case is foraminous, and a peg or the like extends through a hole in the adjustment beam and into the upper opening in the second transverse beam. Adjustment of the easel in this case merely entails removal of the peg, manual sliding of the second pair of beams relative to the first pair of beams, alignment of another hole in the adjustment beam with the opening in the second transverse beam, and reinsertion of the peg. In most cases, the foraminous adjustment beam will be provided with a plurality of spaced-apart holes centrally disposed in a linear array along the longitudinal axis of the adjustment beam.

The principal advantage of the present adjustable easel, as mentioned supra, is that the easel is adjustable in a variety of ways, both with regard to inclination and also with regard to partial rotation about a vertical axis. Thus, the easel is fully adjustable to the best disposition suitable to the artist or painter, both with regard to the subject being painted and also with regard to the light source. This latter aspect is especially important in outdoor work, as the position of the sun in the sky and the direction of light rays from the sun changes with time. Thus, the easel may be turned in or to any position for best light, without necessitating relocation of the artist or loss of concentration on the subject being painted. The easel is fully rotatable by 360° and thus does not have to be lifted off of a base or support surface in order to change its orientation. The movable adjustments of vertical inclination permit the easel to be adjusted or laid at many angles for painting or drafting, e.g. typically from 0° to 40° from vertical orientation. The slide adjustment at the base of the easel gives a variety of wider angles.

The invention accordingly consists in the features of construction, combination of elements, and arrangement of parts, which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
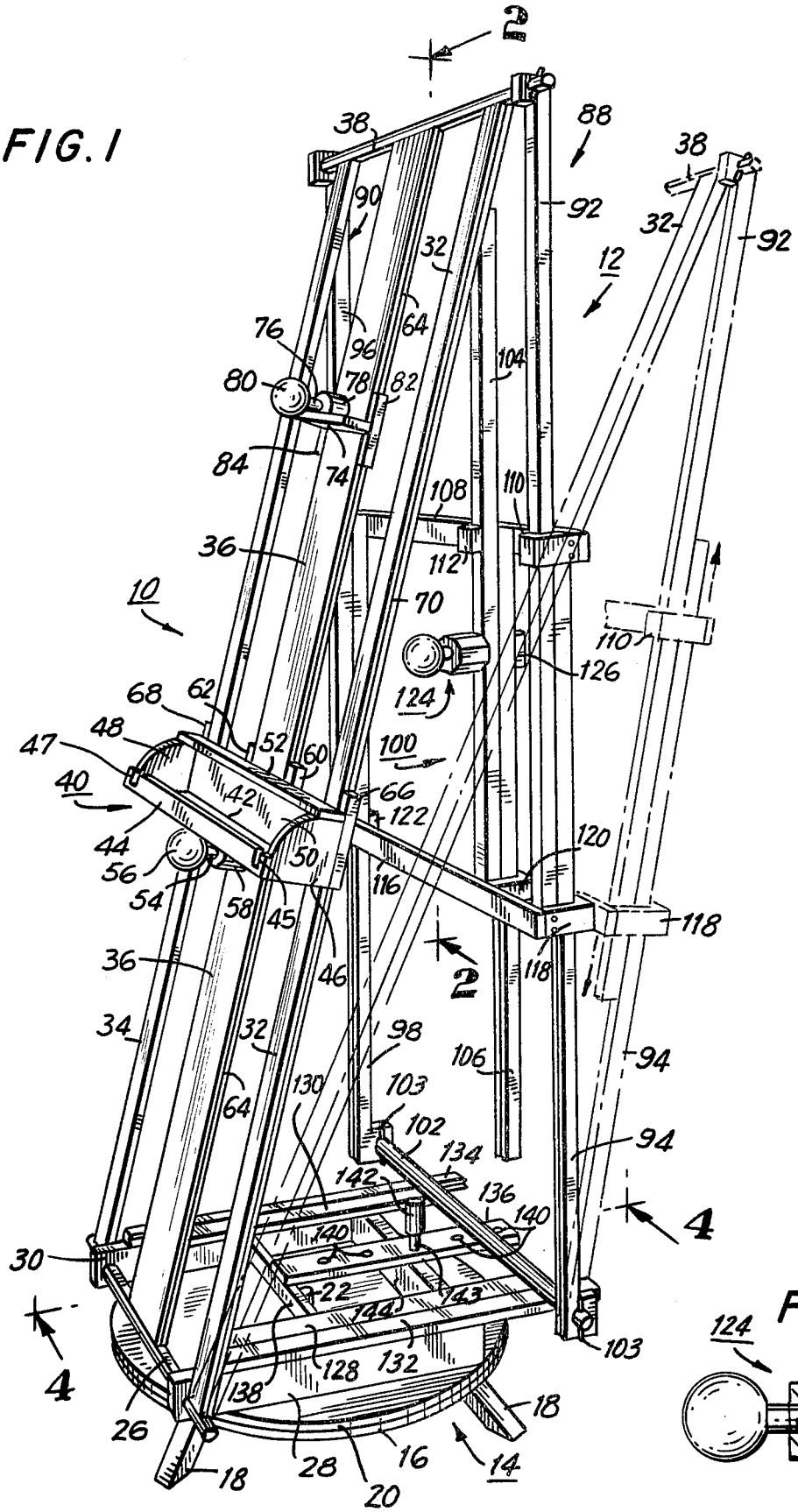
FIG. 1 is an overall perspective view of the easel.
Figure 3:
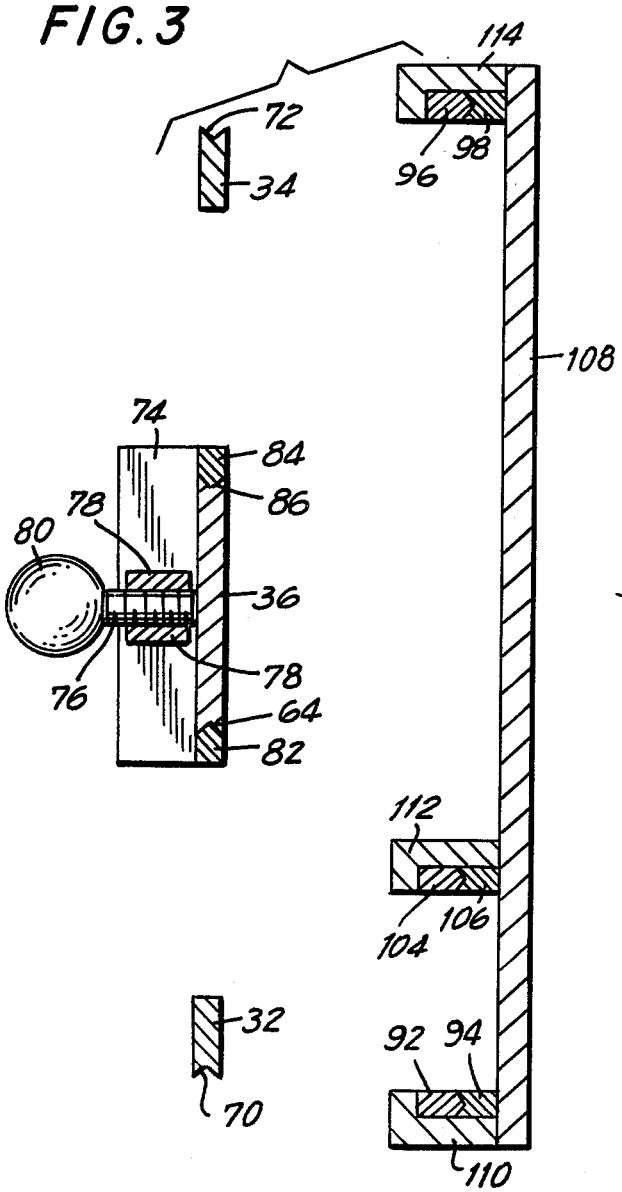
FIG. 3 is a sectional plan view taken substantially along the line 3—3 of FIG. 2.
Figure 2:
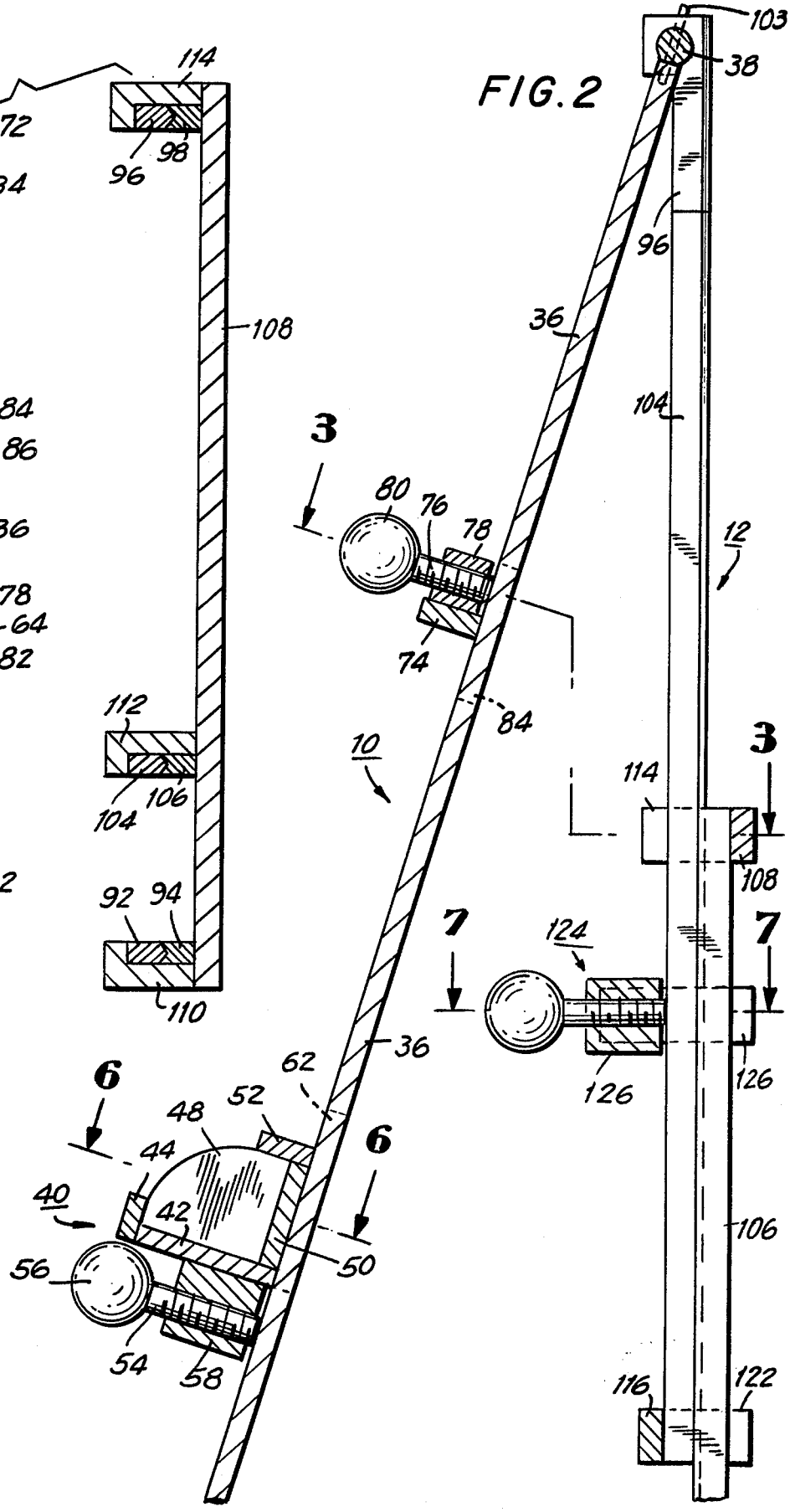
FIG. 2 is a sectional elevation view taken substantially along the line 2—2 of FIG. 1.

Referring now to FIGS. 1, 2 and 3, the adjustable easel is generally characterized by the provision of a front section 10 on which an object, not shown, such as a painting or other artist's work, or a drafting board, or the like substantially flat object having a lower edge is mounted, together with a rear section 12 having integral adjustment means, and a base section 14 also having integral adjustment means and a rotatable platform.

A stationary flat horizontal circular of disc-shaped base platform 16 is mounted on and supported by spaced-apart legs 18. A movable flat horizontal circular or disc-shaped platform 20 is pivotally mounted on the base platform 16 by means of a central vertical pivot pin 22, best shown in FIG. 4, which pin 22 is attached to platform 16 by dowel 24 so that the upper platform 20 may freely rotate about a central vertical axis and relative to the base platform 16. In this preferred embodiment of the invention, the platforms 16 and 20 are of equal diameter, however in some instances the diameter of platform 16 may be greater or less than the diameter of platform 20, and in fact members 16 and 20 do not necessarily have to be circular.

A lower first generally horizontal cylindrical rod 26 is pivotally mounted on the movable platform 20, by extending the ends of rod 26 through opposed holes in the spaced-apart parallel generally horizontal straight linear beams 28 and 30 which are disposed and mounted on and attached to the movable platform 20. Thus, the rod 26 may be partially rotated about its central horizontal longitudinal axis.

Front section 10 is generally defined by the opposed generally parallel inclined linear frame members 32 and 34. The lower end of each of the members 32 and 34 is mounted on and attached to the rod 26 adjacent to an end of the rod 26. An inclined linear support member 36 is generally centrally disposed between and parallel to the frame members 32 and 34. The lower end of the support member 36 is mounted on and generally centrally attached to the rod 26. The outline of section 10 is completed by the provision of an upper second generally horizontal cylindrical rod 38. The upper ends of the frame members 32 and 34 and the support member 36 are attached to the rod 38.

Figure 6:
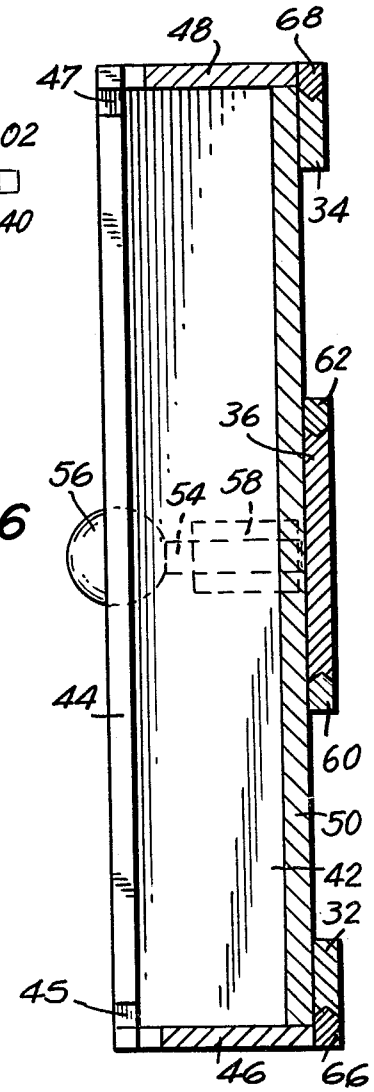
FIG. 6 is a sectional plan view taken substantially along the line 6—6 of FIG. 2.

The front section 10 is completed by the provision of any suitable generally horizontal means to support the lower edge of a substantially flat object, such as a canvas mounted in a rectangular frame and which is to be painted on, a drafting board, or the like. The support means are slidably mounted on the support member 36 by attachment means which are adjustable so that the support means may be slid along the support member 36 to a desired position and thereafter maintained in the desired position by manipulation of the attachment means. In this embodiment of the invention, the support means includes, as best shown in FIGS. 2 and 6, a compartment shelf or tray 40 for retention of pens, pencils, brushes, paint, etc. The compartment tray 40 is of any suitable configuration; in this case it has a base or floor 42, a narrow front barrier wall 44, side walls 46 and 48 each having a curved outer edge, back wall 50, and top generally horizontal platform or wall 52. Recesses 45 and 47, or the like, may be provided in the front wall 44, to serve for the retention of artist's brushes, pens, pencils etc.

The wall 52 functions as substantially horizontal means to support the lower edge of a substantially flat object, which may be any of the items, such as a canvas mounted on a rectangular frame mentioned supra. The support means 52 is integral with the balance of tray 40, and the entire tray 40 is slidably mounted on the support member 36 by suitable attachment means, such means consisting in this embodiment of the invention, of a threaded wooden dowel 54 having a spherical handle 56 by which the dowel 54 may be grasped and rotated. The dowel 54 is threaded into a support member 58 which depends from the bottom wall 42, so that when the dowel 54 is screwed inwards and towards support member 36, the inner end of dowel 54 presses against member 36 and restrains the tray 40 against sliding motion along member 36. The tray 40 is held in contact with support member 36 by means of guide and mounting members 60 and 62 which are attached to the rear of the rear wall 50 and which are provided with inner portions of triangular cross-section which fit into and slide along lateral grooves or channels such as channel 64 in support member 36. In other words, a tongue and groove fitting is provided. When it is desired to change the elevation of tray 40, the dowel 54 is rotated out of contact with member 36 and the entire assemblage is merely manually slid along support member 36 to a desired new location at which dowel 54 is rotated in the opposite direction to again attain contact with support member 36.

Outer guide members 66 and 68 are also provided, for lateral rigidity and mounting of the tray 40. The guide members 66 and 68 are attached to the rear laterally outer edges of back wall 50, and members 66 and 68 slide along in lateral grooves or channels disposed along the respective outer edges of frame members 32 and 34. Thus, a groove 70 is provided in frame member 32 and a groove 72 (FIG. 3) is provided in frame member 34. As will appear infra, tongue and groove fittings are used throughout for sliding contact between members, although other types of fittings or joints are of course feasible.

An upper mounting bracket 74 is preferably also provided. The bracket 74 extends outwards from the inclined linear support member 36 above the support tray 40, and in particular above top wall 52, and the bracket 74 is slidably mounted on the support member 36 by adjustable clamping means comparable to those provided for tray 40 as described supra, namely a threaded wooden dowel 76 which screws into support member 78 and which has a spherical handle 80. A pair of opposed lateral guide and mounting members 82 and 84 are attached to the lateral corners of bracket 74, and the members 82 and 84 slide in lateral grooves 64 and 86 (FIG. 3) in support member 36, in the tongue and groove configuration as described supra. The function of the bracket 74 is to furnish a top mounting and restraint for whatever flat object, such as a canvas painting mounted in a rectangular frame, which may be mounted on member 52 so as to rest against support member 36, and, in most instances, also against frame members 32 and 34.

Referring now to the upper portion of the easel, as mentioned supra, the upper ends of the frame members 32 and 34 and the support member 36 are attached to the substantially horizontal cylindrical rod 38. In addition, the upper ends of opposed inclined linear frame members 88 and 90 are pivotally attached to the ends of rod 38, so that each of the frame members 88 and 90 depend from adjacent an end of rod 38. The frame members 88 and 90 are substantially parallel, and in this embodiment of the invention, each of the frame members 88 and 90 are in two sections. Thus, the frame member 88 consists of an upper first section 92 and a lower second section 94; similarly the frame member 90 consists of an upper first section 96 and a lower second section 98.

The lower portions of each of the upper sections 92 and 96 are slidably juxtaposed with the upper portions of the respective lower sections 94 and 98. In this case, the attachment means between the upper and lower sections, generally designated as 100, is adjustable so that the lower portions of the first (upper) sections 92 and 96 may be slidable along the upper portions of the second (lower) sections 94 and 98 to a desired position, and thereafter maintained in the desired position by manipulation of the attachment means 100. The phantom outline (FIG. 1) shows an increase in the rearward inclination of the upper part of the easel, as the front frame members, such as 32, and the support member, pivot about their lower attachment via rod 26 to members 28 and 30, and as the upper end of upper sections such as 92 and 96 pivot about their attachment to rod 38, while the lower ends of lower sections 94 and 98 pivot about their lower attachment to a third substantially horizontal cylindrical rod 102.

The rod 102 extends between and is pivotally attached to the lower ends of the third and fourth frame members 88 and 90; in this case rod 102 is attached to the lower ends of the lower sections 94 and 98. As will appear infra, the rod 102 is mounted on the same framework and means to which the first rod 26 is mounted on the movable platform, and the pivotal attachments and slidable engagements described supra, constitute some of the integral means to adjust the inclination of both the first and second frame members 32 and 34 and the support member 36.

Figure 7:
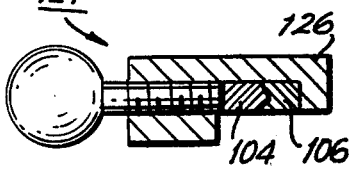
FIG. 7 is a sectional plan view taken substantially along the line 7—7 of FIG. 2.

Returning now to the attachment means generally designated as 100, this attachment means 100 entails the provision of upper first straight linear beam 104 and lower second straight linear beam 106. The beams 104 and 106 are partially slidably engaged relative to each other and are parallel to and spaced between the frame members 88 and 90. The beam 104 is attached to the first sections 92 and 96 by means of a lateral horizontal beam 108 and fittings 110, 112 and 114; the beam 106 is attached to the second sections 94 and 98 by means of a lateral horizontal beam 116 and fittings 118, 120 and 122. In addition, adjustable means consisting in this case of a threaded dowel 124, which is similar in configuration and function to the threaded dowels 54 and 76 described supra, and a fitting 126, is provided to clamp together the juxtaposed portions of the first and second beams 104 and 106 as best shown in FIG. 7, and thus in turn to restrain the upper portions 92 and 96 of the frame members 88 and 90 from slidable movement relative to the lower portions 94 and 98, unless and until the angle of inclination of the easel is being changed. It will be appreciated that, as described supra, all sliding contact between members, such as between the beams 104 and 106, is by means of tongue and groove configurations.

Figure 4:
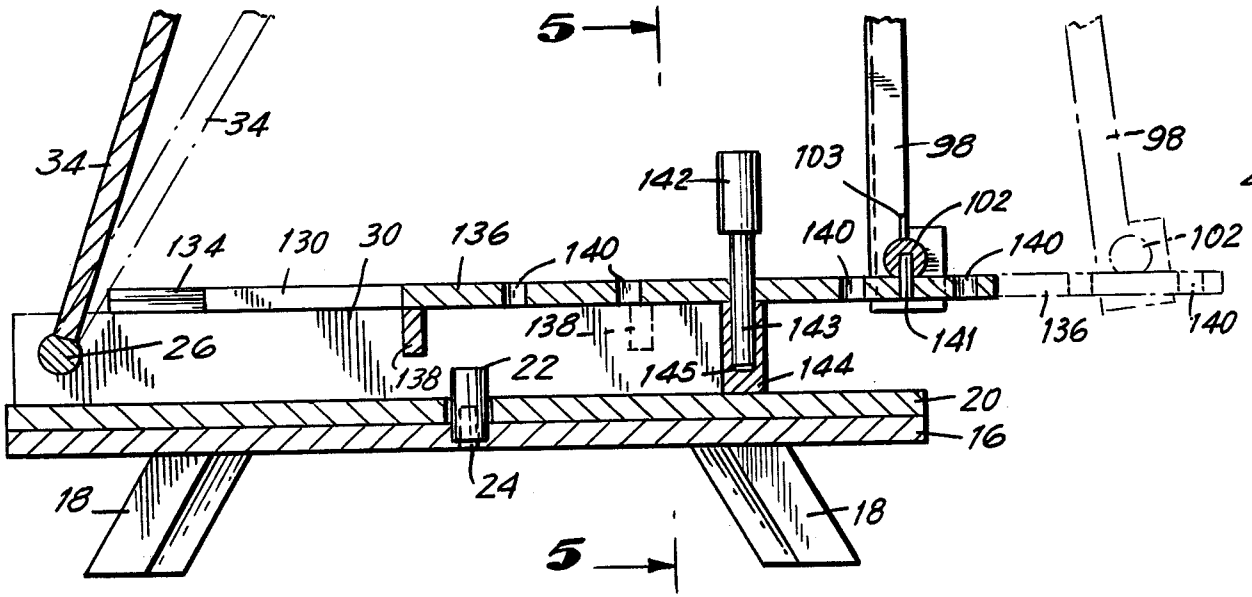
FIG. 4 is a sectional elevation view taken substantially along the line 4—4 of FIG. 1.
Figure 5:
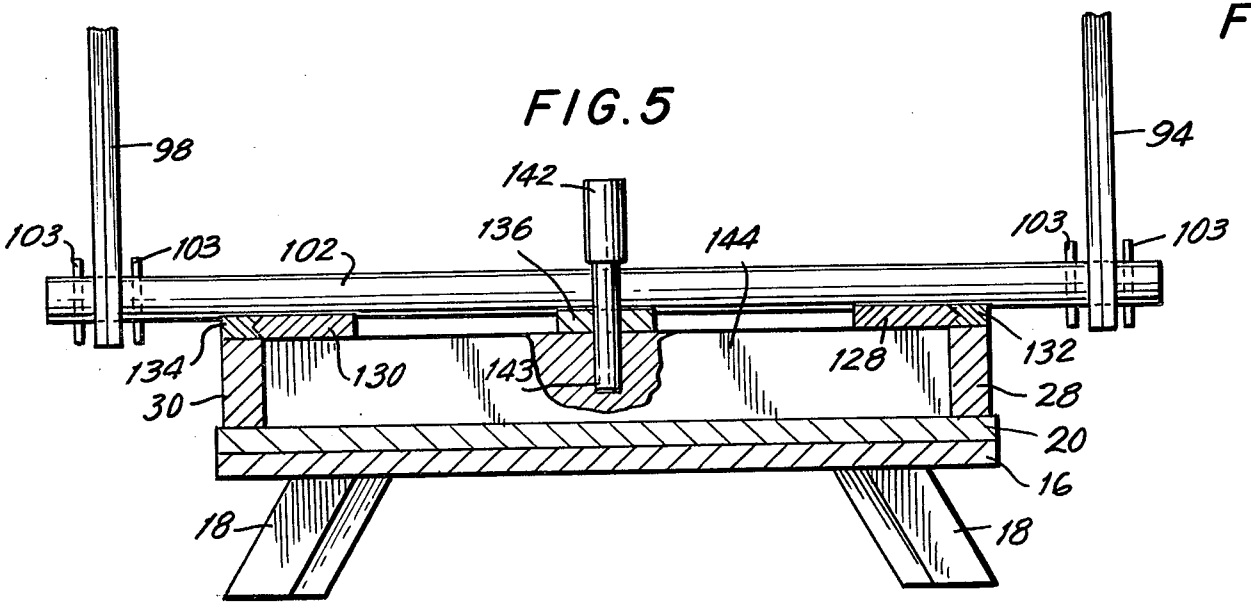
FIG. 5 is a sectional elevation view taken substantially along the line 5—5 of FIG. 4.

Returning now to the lower portion of the easel, the rod 102 is mounted on and attached to the movable parallel spaced-apart inner horizontal beams 128 and 130, which slidingly engage the fixed parallel spaced-apart outer horizontal beams 132 and 134 in a tongue and groove engagement, as best shown in FIG. 5. The outer beams 132 and 134 are attached to the respective support beams 28 and 30. To complete the movable portion of the lower assemblage of elements, a central horizontal beam 136, which is also attached to rod 102, extends parallel to and between the beams 128 and 130; and the inner end of the beam 136 is attached to the middle of a transverse support beam 138 which extends between and is attached to both of the movable beams 128 and 130. The beam 136 is foraminous, i.e. beam 136 is provided with a plurality of spaced-apart holes 140 which are aligned in a linear array along the central longitudinal axis of beam 136. A displaceable pin 142 has a lower portion 143 which extends through one of the holes 140 and thence through a hole or opening in the upper portion of a transverse stationary beam 144, which beam 144 is affixed to and mouned on the disc 20. The ends of the beams 144 are also preferably attached to the beams 28 and 30; as shown in FIG. 5, the beams 128 and 130 rest on the upper edge of beam 144. FIG. 4 shows how the beam 136 and appurtenances thereto including rod 102 are displaceable rearwards (phantom outline), to provide a further adjustment of the easel. This is accomplished by manually removing the pin 142, sliding rearwards the assemblage including elements 136, 138, 128, 130 and 102, all of which are attached together, and re-inserting the pin 142 when another hole 140 is aligned with the hole or opening 145 in the beam 144. Concomitantly with the aforementioned sliding motion, the lower ends of the frame members or sections 94 and 98 pivot about their attachment to the rod 102.

In summary, the adjustable lower portion of the easel consists of means mounting the first and third rods (26, 102) on the movable platform 20, which means includes first and second spaced-apart substantially horizontal straight linear beams (28, 30) which are disposed on and attached to the movable platform 20, which beams 28 and 30 extend rearwards from pivotal attachment to the rod 26 and are substantially perpendicular to the rod 26. The means further includes third and fourth spaced-apart substantially horizontal straight linear beams 128 and 130, with beam 128 slidably engaging beam 28 via beam 132, and with beam 130 slidably engaging beam 30 via beam 134, and with the beams 128 and 130 being laterally connected via beam 138 and rod 102, so that the beams 128 and 130 (together with beam 136) are horizontally displaceable in unison. As mentioned supra, the transverse beam 138 functions as a connection and stiffening beam to give structural integrity and rigidity to the slidable elements, while beam 136 is an adjustment beam which extends substantially perpendicularly from attachment to the transverse beam 138 and which is provided with slide adjustment means. In this preferred embodiment of the invention, the slide adjustment means includes a second transverse beam 144 below the adjustment beam 136, which beam 144 is attached to the beams 28 and 30 and/or to the movable platform 20 and is provided with an upper opening to accomodate the lower part 143 of pin or peg 142. The adjustment beam 136 is foraminous, and the portion 143 of the pin or peg 142 extends through a hole 140 in the adjustment beam 136 and into the upper opening 145 in the transverse beam 144.

It thus will be seen that there is provided an adjustable easel which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Thus, numerous alternatives within the scope of the present invention will occur to those skilled in the art, and some of these alternatives may be mentioned. A dowel 141 comparable in function to dowel 24 mentioned supra connects members 136 and 102 (FIG. 4). The bottom surface of member 38 will peferably be flattened as shown (FIG. 1) to accomodate for the flat upper ends of members 32, 34 and 36, which are attached to member 38 by gluing. Similarly, the top surface of member 26 will preferably be flattened to accommodate for the flat lower ends of members 32, 34 and 36. Small dowels 103 (FIG. 5) typically of $\frac{1}{4}$ inch diameter may extend through member 102 adjacent to the lower ends of members 94 and 98 to prevent lateral movement of these lower ends. Similarly considerations apply to the upper ends of members 92 and 96 vis-a-vis member 38. Many other alternatives and variations within the scope of the present invention will occur to those skilled in the art.

Having thus described the invention, there is claimed as new and desired to be secured by Letters Patent:

1. An adjustable easel which comprises a substantially horizontal base platform, a flat substantially horizontal movable platform pivotally mounted on said base platform, so that said movable platform may be at least partially rotated relative to said base platform, a first substantially horizontal rod, means mounting said first rod on said movable platform, so that said first rod may be partially rotated about its central longitudinal axis, first and second opposed inclined linear frame members, said first and second frame members being substantially parallel, the lower end of each of said first and second frame members being mounted on said first rod adjacent to an end of said first rod, an inclined linear support member, said support member being substantially centrally disposed between and parallel to said first and second frame members, the lower end of said support member being mounted substantially centrally on said first rod, a second substantially horizontal rod, the upper ends of said first and second frame members and said support member being attached to said second rod, substantially horizontal means to support the lower edge of a substantially flat object, said support means being slidably mounted on said support member by attachment means, said attachment means being adjustable so that said support means may be slid along said support member to a desired position and thereafter maintained in the desired position by manipulation of said attachment means, third and fourth opposed inclined linear frame members, said third and fourth frame members being substantially parallel, each of said third and fourth frame members pivotally depending from adjacent an end of said second rod, a third substantially horizontal rod, said third rod extending between and being pivotally attached to the lower ends of said third and fourth frame members, said third rod being mounted on said means mounting said first rod on said movable platform, and integral means to adjust the inclination of said first and second frame members and said support member.

2. The adjustable easel of claim 1 in which the base platform and the movable platform are disc-shaped and coaxial, the pivotal mounting of the movable platform on the base platform being at the center of both the movable platform and the base platform.

3. The adjustable easel of claim 2 in which the base platform and the movable platform are of equal diameter.

4. The adjustable easel of claim 1 in which the integral inclination adjustment means comprises means to adjust the distance between said first rod and said third rod.

5. The adjustable easel of claim 1 in which the integral inclination adjustment means comprises a first and a second section of each of the third and fourth frame members, a lower portion of said first section being slidably juxtaposed with an upper portion of said second section, together with second attachment means, said second attachment means extending between the juxtaposed portions of said first and second sections, said second attachment means being adjustable so that said lower portion of said first section may be slidable along the upper portion of said second section to a desired position and thereafter maintained in the desired position by manipulation of said second attachment means.

6. The adjustable easel of claim 5 in which the second attachment means comprises first and second straight linear beams, said first and second beams being partially slidably engaged relative to each other and being parallel to and spaced between the third and fourth frame members, said first beam being attached to the first section of each of the third and fourth frame members, said second beam being attached to the second section of each of the third and fourth frame members, together with adjustable means to clamp together the juxtaposed portions of the first and second beams.

7. The adjustable easel of claim 6 in which the adjustable clamping means is a threaded dowel.

8. The adjustable easel of claim 1 in which the attachment means by which the support means is slidably mounted on the support member is a threaded dowel, said threaded dowel serving to adjustably clamp the support means to the support member.

9. The adjustable easel of claim 1 in which an upper bracket extends outwards from the inclined linear support member above the support means, said upper bracket being slidably mounted on the support member by adjustable clamping means.

10. The adjustable easel of claim 9 in which the adjustable clamping means is a threaded dowel.

11. The adjustable easel of claim 1 in which the means mounting the first and third rods on the movable platform comprises first and second spaced-apart substantially horizontal straight linear beams disposed on and attached to the movable platform, said first and second beams extending rearwards from pivotal attachment to said first rod and being substantially perpendicular to said first rod, together with third and fourth spaced-apart substantially horizontal straight linear beams, said third beam slidably engaging said first beam, said fourth beam slidably engaging said second beam, said third and fourth beams being laterally connected so that said third and fourth beams are horizontally displaceable in unison, the third rod being attached to both said third beam and said fourth beam.

12. The adjustable easel of claim 11 in which said third and fourth beams are laterally connected by at least one transverse beam, together with an adjustment beam, said adjustment beam extending substantially perpendicularly from attachment to said transverse beam and being provided with slide adjustment means.

13. The adjustable easel of claim 12 in which the slide adjustment means comprises a second transverse beam below the adjustment beam, said second transverse beam being attached to the first and second beams and/or to the movable platform and being provided with an upper opening, the adjustment beam being foraminous, together with a peg, said peg extending through a hole in the adjustment beam and into the upper opening in the second transverse beam.

14. The adjustable easel of claim 13 in which the foraminous adjustment beam is provided with a plurality of spaced-apart holes in a linear array along the longitudinal axis of the adjustment beam.

* * * * *